US009343045B1

(12) United States Patent
Kennamore et al.

(10) Patent No.: US 9,343,045 B1
(45) Date of Patent: May 17, 2016

(54) CAPO SYSTEM

(71) Applicants: Jason Kennamore, Perry, FL (US); Ashley Kennamore, Perry, FL (US)

(72) Inventors: Jason Kennamore, Perry, FL (US); Ashley Kennamore, Perry, FL (US)

( * ) Notice: Subject to any disclaimer, the term of this patent is extended or adjusted under 35 U.S.C. 154(b) by 0 days.

(21) Appl. No.: 14/736,610

(22) Filed: Jun. 11, 2015

(51) Int. Cl.
*G10D 3/04* (2006.01)

(52) U.S. Cl.
CPC ..... *G10D 3/043* (2013.01)

(58) Field of Classification Search
CPC ..... G10D 3/043; G10D 3/00; G10D 3/14; G10D 1/08; G10D 3/06; G10H 1/44
USPC ..... 84/315–318
See application file for complete search history.

(56) References Cited

U.S. PATENT DOCUMENTS

| | | | | |
|---|---|---|---|---|
| 3,818,793 | A | 6/1974 | Round | |
| 4,189,279 | A | 2/1980 | Anderson | |
| 4,331,059 | A | 5/1982 | Marabotto | |
| 4,334,457 | A | 6/1982 | Spoonts, III | |
| 4,926,732 | A | 5/1990 | Collins et al. | |
| 5,623,110 | A | 4/1997 | Hoglund et al. | |
| 7,557,285 | B2 | 7/2009 | Ward | |
| 2007/0227334 | A1 * | 10/2007 | Ward | G10D 3/043 84/318 |
| 2010/0224049 | A1 * | 9/2010 | Tran | G10D 3/043 84/318 |
| 2012/0036978 | A1 * | 2/2012 | Del Priore | G10D 3/043 84/318 |

FOREIGN PATENT DOCUMENTS

| | | |
|---|---|---|
| WO | WO2010030959 | 3/2010 |

* cited by examiner

*Primary Examiner* — Kimberly Lockett

(57) ABSTRACT

A capo system includes a stringed instrument that has a neck, a fret board and a plurality of strings. A housing is removably positioned at a desired location along the fret board. A plurality of engaging units is provided and each of the engaging units is positioned within the housing. Each of the engaging units is positioned within an associated one of the channels. Each of the engaging units is positionable between an engaging position having each of the engaging units selectively depressing associated ones of the strings onto the fret board. Each of the engaging units is positionable in a releasing position having each of the engaging units being spaced from the associated string such that the associated string is spaced from the fret board.

12 Claims, 3 Drawing Sheets

CAPO SYSTEM

BACKGROUND OF THE DISCLOSURE

Field of the Disclosure

The disclosure relates to capo devices and more particularly pertains to a new capo device for depressing selected strings against a fret board of a stringed instrument.

SUMMARY OF THE DISCLOSURE

An embodiment of the disclosure meets the needs presented above by generally comprising a stringed instrument that has a neck, a fret board and a plurality of strings. A housing is removably positioned at a desired location along the fret board. A plurality of engaging units is provided and each of the engaging units is positioned within the housing. Each of the engaging units is positioned within an associated one of the channels. Each of the engaging units is positionable between an engaging position having each of the engaging units selectively depressing associated ones of the strings onto the fret board. Thus, the engaging units facilitate a user to build otherwise unbuildable chords using only the hands and conventional capos which engage a straight line of strings. Each of the engaging units is positionable in a releasing position having each of the engaging units being spaced from the associated string such that the associated string is spaced from the fret board.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
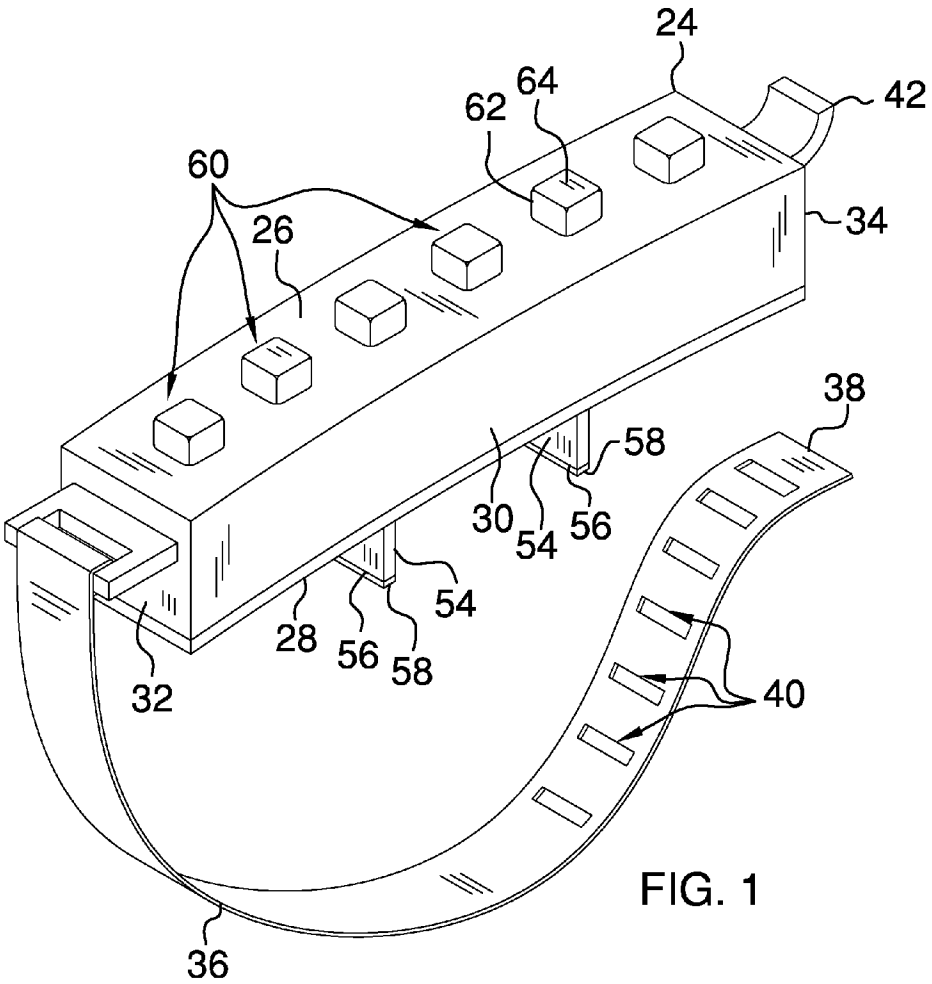
FIG. 1 is a perspective view of a capo system according to an embodiment of the disclosure.
Figure 2:
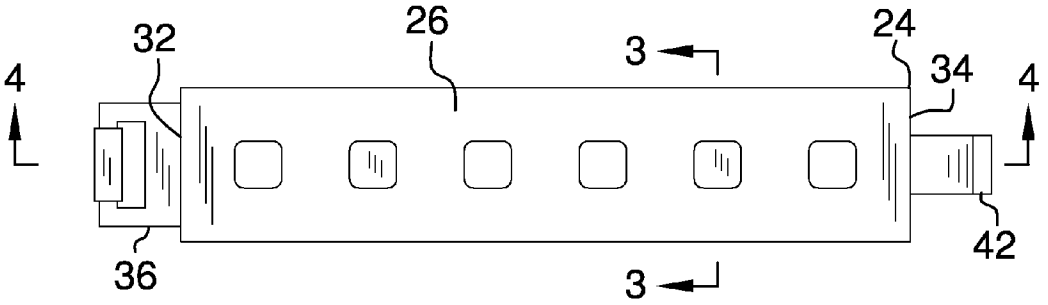
FIG. 2 is a top view of an embodiment of the disclosure.
Figure 3:
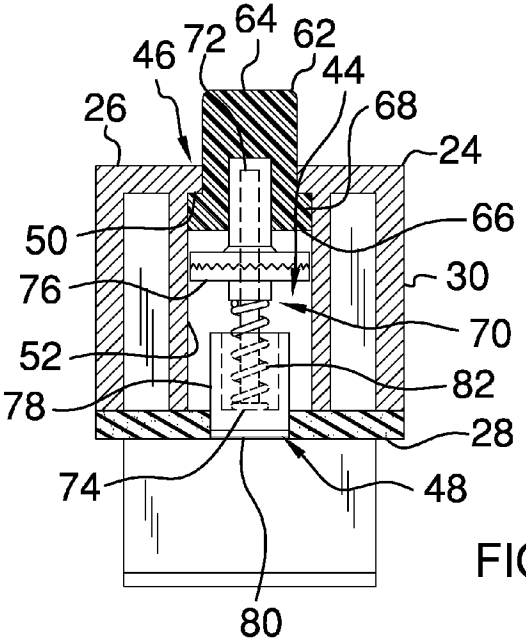
FIG. 3 is a cross sectional view taken along line 3-3 of FIG. 2 of an embodiment of the disclosure.
Figure 4:
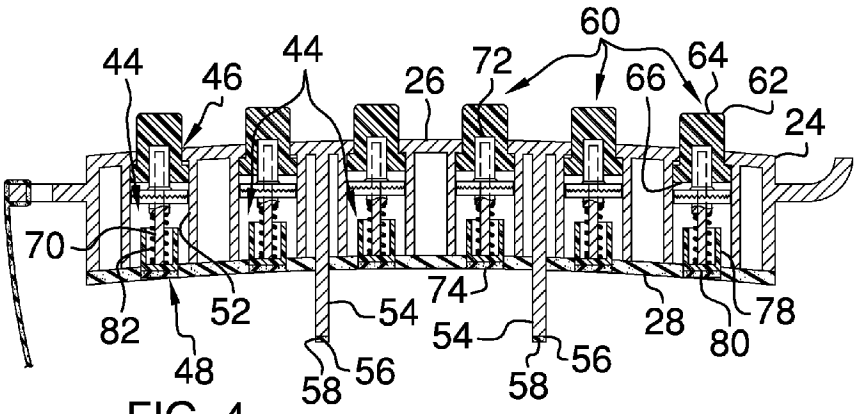
FIG. 4 is a cross sectional view taken along line 4-4 of FIG. 2 of an embodiment of the disclosure.
Figure 5:
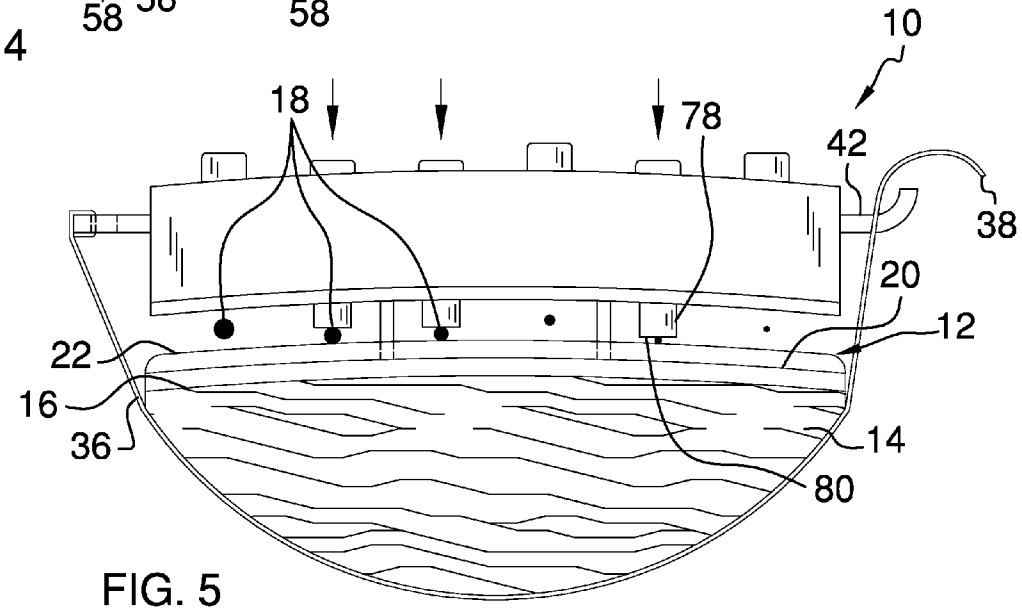
FIG. 5 is a perspective in-use view of an embodiment of the disclosure.

With reference now to the drawings, and in particular to FIGS. 1 through 5 thereof, a new capo device embodying the principles and concepts of an embodiment of the disclosure and generally designated by the reference numeral 10 will be described.

As best illustrated in FIGS. 1 through 5, the capo system 10 generally comprises a stringed instrument 12 that has a neck 14, a fret board 16 and a plurality of strings 18. The fret board 16 has a top surface 20 and the strings 18 are spaced from the top surface 20. Additionally, the fret board 16 may have at least one fret 22 that is attached the top surface 20. The stringed instrument 12 may be a guitar, a banjo, a mandolin or other stringed instrument utilizing strings 18 and a fret board 16.

A housing 24 is removably positioned at a desired location along the fret board 16. The housing 24 has a top wall 26, a bottom wall 28 and a peripheral wall 30 extending between the top wall 26 and the bottom wall 28. The peripheral wall 30 has a first lateral side 32 and a second lateral side 34. The bottom wall 28 may be comprised of a resiliently compressible material such as rubber or the like.

A strap 36 is coupled to the first lateral side 32 and the strap 36 has a distal end 38 with respect to the first lateral side 32. The strap 36 has a plurality of openings 40 extending therethrough. The openings 40 are spaced apart from each other and distributed from the distal end 38 toward the first lateral side 32. A hook 42 is attached to the second lateral side 34. The strap 36 is wrapped around the neck 14 and the hook 42 is extended through a selected one of the openings 40 thereby retaining the housing 24 at the selected location along the fret board 16.

The housing 24 has a plurality of channels 44 extending through the top wall 26 and the bottom wall 28. The channels 44 are spaced apart from each other and are distributed along the housing 24. Each of the channels 44 has a top opening 46, a bottom opening 48, an upper bounding surface 50 and a lateral bounding surface 52. The top opening 46 and the bottom opening 48 of each of the channels 44 has a diameter that is less than a diameter of the channels 44.

A pair of spacers 54 is provided and each of the spacers 54 is attached to the housing 24. Each of the spacers 54 is positioned on the bottom wall 28 and the spacers 54 are spaced apart from each other. Each of the spacers 54 has a distal end 56 with respect to the bottom wall 28. The distal end 56 of each of the spacers 54 abuts the top surface 20 of the fret board 16 when the housing 24 is positioned on the fret board 16 such that the housing 24 is spaced from the top surface 20. A pair of pads 58 is each attached to the distal end 56 of an associated one of the spacers 54. Each of the pads 58 may be comprised of a resiliently compressible material such as rubber or the like.

A plurality of engaging units 60 is provided. Each of the engaging units 60 is positioned within the housing 24 and each of the engaging units 60 is positioned within an associated one of the channels 44. Each of the engaging units 60 is positionable between an engaging position having each of the engaging units 60 selectively depressing associated ones of the strings 18 onto the fret board 16. Thus, the engaging units 60 facilitate a user to build otherwise unbuildable chords. Each of the engaging units 60 is positionable in a releasing position having each of the engaging units 60 being spaced from the associated string 18 such that the associated string 18 is spaced from the fret board 16.

Each of the engaging units 60 comprises a button 62 that has a top end 64 and a bottom end 66. The button 62 is slidably positioned within an associated one of the channels 44 such that top end 64 extends outwardly from the top opening 46 of the associated channel 44. The button 62 includes a lip 68 flaring outwardly from the button 62 and the lip 68 is positioned adjacent to the bottom end 66. The lip 68 engages the upper bounding surface 50 of the associated channel 44 such that the button 62 is retained within the top opening 46 of the associated channel 44. The top end 64 may be manipulated such that an associated one of the engaging units 60 is positioned between the engaging position and the releasing position.

A lock 70 is provided that has a first end 72 and a second end 74 and the lock 70 is slidably positioned within an associated one of the channels 44. The lock 70 is elongated between the first end 72 and the second end 74 and the first end 72 engages the bottom end 66 of the button 62. The lock 70 has a retention portion 76 and the retention portion 76 is centrally positioned between the first end 72 and the second end 74. The retention portion 76 of the lock frictionally engages the lateral bounding surface 52 of the associated channel 44 when the button 62 is manipulated to position the associated engaging unit 60 in the engaging position. Thus, the associated engaging unit 60 is retained in the engaging position. The retention portion 76 of the lock frictionally disengages from the lateral bounding surface 52 of the associated channel 44 when the button 62 is manipulated to position the associated engaging unit 60 in the releasing position. The lock 70 may comprise a ball point pen retraction mechanism or the like.

A pedestal 78 is provided that has an engaging surface 80. The pedestal 78 is positioned within an associated one of the channels 44 such that the pedestal 78 is positioned within the bottom opening 48 of the associated channel 44. The second end 74 of the lock 70 engages the pedestal 78. The pedestal 78 extends downwardly out of the bottom opening 48 when an associated one of the engaging units 60 is positioned in the engaging position. Thus, the engaging surface 80 of the pedestal 78 compresses the associated string 18 against the fret board 16. The engaging surface 80 is aligned with the bottom wall 28 of the housing 24 when the associated engaging unit 60 is positioned in the releasing position.

A biasing member 82 is positioned around the lock 70. The biasing member 82 extends between the second end 74 and the retention portion 76. The biasing member 82 biases the associated engaging unit 60 into the releasing position. The biasing member 82 may comprise a spring biasing member.

In use, the housing 24 is positioned at the selected location along the fret board 16 and the strap 36 is secured around the neck 14. Selected ones of the buttons 62 are manipulated to position the associated engaging units 60 in the engaging position. Thus, the associated strings 18 with respect to the associated engaging units 60 are compressed against the fret 22 thereby changing an open note of the associated strings 18. Any number of the engaging units 60 may be positioned in the engaging position or the releasing position at any time. The housing 24 is positioned at any desired location along the fret board 16.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A capo system for building unique chords on a stringed instrument, said system comprising:

a stringed instrument having a neck, a fret board and a plurality of strings;

a housing being removably positioned at a desired location along said fret board, said housing having a plurality of channels, each of said channels having a bottom opening;

a plurality of engaging units, each of said engaging units being positioned within said housing, each of said engaging units being positioned within an associated one of said channels, each of said engaging units being positionable between an engaging position having each of said engaging units selectively depressing associated ones of said strings onto said fret board wherein said engaging units are configured to facilitate a user to build otherwise unbuildable chords, each of said engaging units being positionable in a releasing position having each of said engaging units being spaced from said associated string such that said associated string is spaced from said fret board;

a lock having a first end and a second end; and a pedestal having an engaging surface, said pedestal being positioned within an associated one of said channels such that said pedestal is positioned within said bottom opening of said associated channel, said second end of said lock engaging said pedestal.

2. The system according to claim 1, wherein said housing has a top wall, a bottom wall and a peripheral wall extending between said top wall and said bottom wall, said plurality of channels extending through said top wall and said bottom wall.

3. A capo system for building unique chords on a stringed instrument, said system comprising:

a stringed instrument having a neck, a fret board and a plurality of strings;

a housing being removably positioned at a desired location along said fret board, wherein said housing has a top wall, a bottom wall and a peripheral wall extending between said top wall and said bottom wall, said housing having a plurality of channels extending through said top wall and said bottom wall;

a plurality of engaging units, each of said engaging units being positioned within said housing, each of said engaging units being positioned within an associated one of said channels, each of said engaging units being positionable between an engaging position having each of said engaging units selectively depressing associated ones of said strings onto said fret board wherein said engaging units are configured to facilitate a user to build otherwise unbuildable chords, each of said engaging units being positionable in a releasing position having each of said engaging units being spaced from said associated string such that said associated string is spaced from said fret board; and said channels being spaced apart from each other and being distributed along said housing, each of said channels having a top opening, a bottom opening, an upper bounding surface and a lateral bounding surface, said top opening and said bottom opening of each of said channels having a diameter being less than a diameter of said channels.

4. The system according to claim 3, further comprising:

said fret board having a top surface; and a pair of spacers, each of said spacers being attached to said housing, each of said spacers being positioned on said bottom wall, said spacers being spaced apart from each other, each of said spacers having a distal end with respect to said bottom wall, said distal end of each of said spacers abutting said top surface of said fret board when said housing is positioned on said fret board such that said housing is spaced from said top surface.

5. The system according to claim 1, wherein:

each of said channels having a top opening; and each of said engaging units comprises a button having a top end and a bottom end, said button being slidably positioned within an associated one of said channels such that top end extends outwardly from said top opening of said associated channel.

6. A capo system for building unique chords on a stringed instrument, said system comprising:

a stringed instrument having a neck, a fret board and a plurality of strings;

a housing being removably positioned at a desired location along said fret board;

a plurality of engaging units, each of said engaging units being positioned within said housing, each of said engaging units being positioned within an associated one of said channels, each of said engaging units being positionable between an engaging position having each of said engaging units selectively depressing associated ones of said strings onto said fret board wherein said engaging units are configured to facilitate a user to build otherwise unbuildable chords, each of said engaging units being positionable in a releasing position having each of said engaging units being spaced from said associated string such that said associated string is spaced from said fret board;

said housing has a plurality of channels, each of said channels having a top opening;

each of said engaging units comprises a button having a top end and a bottom end, said button being slidably positioned within an associated one of said channels such that top end extends outwardly from said top opening of said associated channel;

each of said channels has an upper bounding surface; and said button including a lip flaring outwardly from said button, said lip being positioned adjacent to said bottom end, said lip engaging said upper bounding surface of said associated channel such that said button is retained within said top opening of said associated channel, said top end being configured to be manipulated such that an associated one of said engaging units is positioned between said engaging position and said releasing position.

7. A capo system for building unique chords on a stringed instrument, said system comprising:

a stringed instrument having a neck, a fret board and a plurality of strings;

a housing being removably positioned at a desired location along said fret board;

a plurality of engaging units, each of said engaging units being positioned within said housing, each of said engaging units being positioned within an associated one of said channels, each of said engaging units being positionable between an engaging position having each of said engaging units selectively depressing associated ones of said strings onto said fret board wherein said engaging units are configured to facilitate a user to build otherwise unbuildable chords, each of said engaging units being positionable in a releasing position having each of said engaging units being spaced from said associated string such that said associated string is spaced from said fret board;

said housing has a plurality of channels, each of said channels having a top opening;

each of said engaging units comprises a button having a top end and a bottom end, said button being slidably positioned within an associated one of said channels such that top end extends outwardly from said top opening of said associated channel; and a lock having a first end and a second end, said lock being slidably positioned within an associated one of said channels, said first end engaging said bottom end of said button.

8. The system according to claim 7, wherein:

each of said channels has a lateral bounding surface; and said lock has a retention portion, said retention portion being centrally positioned between said first end and said second end.

9. The system according to claim 8, wherein said retention portion of said lock frictionally engages said lateral bounding surface of said associated channel when said button is manipulated to position said associated engaging unit in said engaging position thereby retaining said associated engaging unit in said engaging position, said retention portion of said lock frictionally disengaging from said lateral bounding surface of said associated channel when said button is manipulated to position said associated engaging unit in said releasing position.

10. The system according to claim 1, wherein:

said housing has a bottom wall; and said pedestal extends downwardly out of said bottom opening when an associated one of said engaging units is positioned in said engaging position wherein said engaging surface of said pedestal compresses said string against said fret board, said engaging surface being aligned with said bottom wall of said housing when said associated engaging unit is positioned in said releasing position.

11. The system according to claim 1, further comprising:

said lock having a retention portion; and a biasing member being positioned around said lock, said biasing member extending between said second end and said retention portion, said biasing member biasing said associated engaging unit into said releasing position.

12. The system of claim 1, further comprising:

said fret board having a top surface, said strings being spaced from said top surface;

said housing having a top wall, a bottom wall and a peripheral wall extending between said top wall and said bottom wall, said channels extending through said top wall and said bottom wall, said channels being spaced apart from each other and being distributed along said housing, each of said channels having a top opening, an upper bounding surface and a lateral bounding surface, said top opening and said bottom opening of each of said channels having a diameter being less than a diameter of said channels;

a pair of spacers, each of said spacers being attached to said housing, each of said spacers being positioned on said bottom wall, said spacers being spaced apart from each other, each of said spacers having a distal end with respect to said bottom wall, said distal end of each of said spacers abutting said top surface of said fret board when said housing is positioned on said fret board such that said housing is spaced from said top surface; and each of said engaging units comprising:

a button having a top end and a bottom end, said button being slidably positioned within an associated one of said channels such that top end extends outwardly from said top opening of said associated channel, said button including a lip flaring outwardly from said button, said lip being positioned adjacent to said bottom end, said lip engaging said upper bounding surface of said associated channel such that said button is retained within said top opening of said associated channel, said top end being configured to be manipulated such that an associated one of said engaging units is positioned between said engaging position and said releasing position, said lock being slidably positioned within an associated one of said channels, said first end engaging said bottom end of said button, said lock having a retention portion, said retention portion being centrally positioned between said first end and said second end, said retention portion of said lock frictionally engaging said lateral bounding surface of said associated channel when said button is manipulated to position said associated engaging unit in said engaging position thereby retaining said associated engaging unit in said engaging position, said retention portion of said lock frictionally disengaging from said lateral bounding surface of said associated channel when said button is manipulated to position said associated engaging unit in said releasing position, said pedestal extending downwardly out of said bottom opening when an associated one of said engaging units is positioned in said engaging position wherein said engaging surface of said pedestal compresses said string against said fret board, said engaging surface being aligned with said bottom wall of said housing when said associated engaging unit is positioned in said releasing position, and a biasing member being positioned around said lock, said biasing member extending between said second end and said retention portion, said biasing member biasing said associated engaging unit into said releasing position.

* * * * *